US007134251B2

(12) United States Patent
Zurn et al.

(10) Patent No.: US 7,134,251 B2
(45) Date of Patent: Nov. 14, 2006

(54) REPAIR OF INSULATING GLASS UNITS

(75) Inventors: Benjamin J. Zurn, Roseville, MN (US); Bernie Herron, Bloomington, MN (US); Robert G. Spindler, Eden Prairie, MN (US)

(73) Assignee: Cardinal IG Company, Eden Prairie, MN (US)

( * ) Notice: Subject to any disclaimer, the term of this patent is extended or adjusted under 35 U.S.C. 154(b) by 0 days.

(21) Appl. No.: 10/848,092

(22) Filed: May 18, 2004

(65) Prior Publication Data

US 2004/0211142 A1 Oct. 28, 2004

Related U.S. Application Data

(62) Division of application No. 09/977,103, filed on Oct. 12, 2001, now Pat. No. 6,804,924.

(51) Int. Cl.
*E04G 21/00* (2006.01)

(52) U.S. Cl. ..... 52/514; 52/226; 52/171.3; 408/202

(58) Field of Classification Search ..... 52/514, 52/171.3, 204.52, 204.593, 226; 408/225, 408/226, 224, 202, 241 G, 115 R, 241 S; 411/34; 428/34

See application file for complete search history.

(56) References Cited

U.S. PATENT DOCUMENTS 548,385 A * 10/1895 Nelson ..... 408/202
2,125,372 A 8/1938 Fox
2,183,543 A * 12/1939 Cherry ..... 29/512
2,302,740 A 11/1942 Boicey
2,570,945 A * 10/1951 Hawkins ..... 7/158
2,686,342 A 8/1954 D'Eustachio
2,734,601 A 2/1956 Anderson
2,749,579 A 6/1956 Shaw
2,756,467 A 7/1956 Etling
2,880,475 A 4/1959 Mills
2,886,864 A 5/1959 Boicey et al.
2,887,737 A 5/1959 Prescott
2,964,809 A 12/1960 Gwyn et al.
3,027,607 A 4/1962 Badger et al.
3,078,627 A 2/1963 Dunipace et al.
3,300,798 A * 1/1967 Lee ..... 470/2
3,483,735 A 12/1969 Packo
3,645,642 A * 2/1972 Koslow ..... 408/202
3,793,167 A 2/1974 Glaser
3,935,351 A 1/1976 Franz
3,993,520 A 11/1976 Werner et al.
4,026,512 A 5/1977 Holt
4,035,100 A * 7/1977 Kruger et al. ..... 408/226
4,176,989 A * 12/1979 Wolff ..... 408/115 R
4,204,029 A 5/1980 Batchelor et al.
4,335,166 A 6/1982 Lizardo et al.
4,369,084 A 1/1983 Lisec
4,476,169 A 10/1984 Nishino et al.
4,478,543 A * 10/1984 Lyon ..... 411/34

(Continued)

*Primary Examiner*—Basil Katcheves
(74) *Attorney, Agent, or Firm*—Fredrikson & Byron, PA

(57) ABSTRACT

A method for repairing an insulating glass unit and apparatus to facilitate such repair. A bore is drilled through a frame encasing an insulating glass unit to expose the peripheral spacer of the unit, and a hole is drilled through a wall of the spacer to enable air to enter the space between the panes. The hole in the spacer is then sealed, for example, with a rivet, and the bore in the frame is then filled and sealed as well.

18 Claims, 9 Drawing Sheets

U.S. PATENT DOCUMENTS 4,483,108 A 11/1984 Howard
4,497,476 A 2/1985 Wiele
4,520,602 A 6/1985 Miller
4,567,703 A 2/1986 Ricks
4,587,784 A 5/1986 Chavy et al.
4,592,179 A 6/1986 Boutarin
4,597,727 A 7/1986 Birkhauser, III
4,639,175 A * 1/1987 Wollar ..... 411/38
4,659,268 A * 4/1987 Del Mundo et al. ..... 411/34
4,780,164 A 10/1988 Rueckheim et al.
4,781,878 A 11/1988 Lisec
4,817,354 A 4/1989 Bayer
4,886,095 A 12/1989 Lisec
4,909,874 A 3/1990 Rueckheim
4,932,608 A 6/1990 Heidish et al.
4,941,302 A 7/1990 Barry
5,017,252 A 5/1991 Aldrich et al.
5,069,836 A 12/1991 Werner et al.
5,107,698 A 4/1992 Gilliam
5,288,183 A * 2/1994 Chaconas et al. ..... 408/211
5,299,399 A 4/1994 Baier et al.
5,313,761 A 5/1994 Leopold
5,326,196 A * 7/1994 Noll ..... 408/56
5,345,734 A 9/1994 Tremblay
5,350,469 A 9/1994 Lenhardt et al.
5,366,574 A 11/1994 Lenhardt et al.
5,368,181 A 11/1994 Myers
5,377,473 A 1/1995 Narayan et al.
5,382,120 A * 1/1995 Parsons ..... 408/16
5,439,716 A * 8/1995 Larsen ..... 428/34
5,573,618 A 11/1996 Rueckheim
5,596,151 A 1/1997 Rossini
5,626,712 A 5/1997 Lisec
5,643,644 A 7/1997 Demars
5,645,678 A 7/1997 Lisec
5,676,782 A 10/1997 Lisec
5,679,419 A 10/1997 Larsen
5,705,010 A 1/1998 Larsen
5,714,214 A 2/1998 Larsen
5,735,318 A 4/1998 Vianello
5,753,069 A 5/1998 Rueckheim
5,753,800 A 5/1998 Gilliam
5,762,739 A 6/1998 Lenhardt et al.
5,855,638 A 1/1999 Demars
5,859,363 A 1/1999 Gouge
5,878,538 A 3/1999 Rossini
5,922,944 A 7/1999 Pieroni et al.
5,957,169 A 9/1999 Trpkovski
6,018,615 A 1/2000 Loblick
6,054,195 A 4/2000 Collins et al.
6,142,009 A 11/2000 Loblick
6,158,483 A 12/2000 Trpkovski
6,190,150 B1 2/2001 Beveridge
6,216,751 B1 4/2001 Trpkovski
6,378,254 B1 4/2002 Gould
6,463,706 B1 10/2002 Guhl et al.
6,652,203 B1 * 11/2003 Risen, Jr. ..... 408/225
2003/0221306 A1 * 12/2003 Day et al. ..... 29/525.01

* cited by examiner

REPAIR OF INSULATING GLASS UNITS

This is a Continuation Division of application Ser. No. 09/977,103 filed Oct. 12, 2001 now U.S. Pat. No. 6,804,924.

BACKGROUND OF THE INVENTION

The invention relates to the repair of insulating glass units to equalize pressure between the space between panes and the atmosphere.

BACKGROUND OF THE INVENTION

Insulating glass units are formed generally of a pair of glass panes that are generally parallel to one another and that have a spacer running between them at their peripheries. Spacers, commonly of metal, are adhered by means of a sealant to the glass panes, the sealant desirably forming a gas-tight seal to thus prevent air or other gas from entering or leaving the space between the panes. Insulating glass units are shown, for example, in U.S. Pat. Nos. 5,377,473 and 5,439,716.

To improve the insulating capacity of such glass units, the between-pane space may be filled with argon or other gas that has a coefficient of thermal conductivity less than that of air. Commonly, the between-pane space is filled with argon to a pressure that is approximately atmospheric, although pressure adjustments may be made in connection with the elevation of the geographic locale where the insulating glass unit is to be installed. The periphery of an insulating glass unit is encased in a frame which may be of wood or other material, and the wooden frame in turn may have a weather-resistant plastic coating.

Over a period of time, argon may slowly leak from the between-pane space to the atmosphere. This occurs at a rate greater than the permeation of oxygen or nitrogen into the between-pane space, with the result that the pressure in the between-pane space is reduced below atmospheric pressure. The resulting pressure differential causes the panes to cup inwardly, and the panes can eventually touch near their centers, with consequent loss of insulating value. In some cases, the cupping of the panes is so great as to cause one or the other of the panes to shatter. When failure occurs, the window units necessarily have to be replaced, and this can be extremely expensive in that the failed window unit must be removed, replaced, and reinstalled on a unit-by-unit basis.

When transported to geographic locations of higher elevation and hence reduced atmospheric pressure, the panes of insulating glass units may bulge outwardly under the pressure differential across the panes, and this also causes distortion of the panes and may lead to ultimate glass breakage.

It would be desirable to provide a method and apparatus to enable insulating glass units that bulge or that have become cupped to be repaired without requiring them to be removed from the frames within which they are encased, and without requiring them to be removed from the buildings in which they are installed.

SUMMARY OF THE INVENTION

In connection with insulating glass window units that have bulged or cupped panes due to pressure differentials across the panes, we have found that it is possible to repair the units in situ in a rapid, convenient and low cost manner. Speaking broadly, the method comprises drilling a bore through the frame which encases an insulating glass unit to expose an outer surface of a wall of the spacer, then drilling a hole through the spacer to enable air or other gas to enter or exit from the between-pane space to equalize the pressure between that space and the atmosphere. As the between-pane space reaches atmospheric pressure, the panes substantially regain their original parallelism. We then fill the bore formed in the frame with a waterproof sealing material such as a silicone rubber sealant.

Before filling the bore in the frame with a sealant, we prefer to first seal the hole drilled through the spacer wall, desirably by means of a rivet bearing a sealant. Other methods of sealing the spacer wall involve use of a small screw that is screwed into the hole formed in the spacer wall, the screw preferably also bearing a sealant to seal the hole n the spacer wall. One may also use an expanding screw, of the type used to mount pictures through dry wall panels. One such screw carries an expandable collar at its tip which expands into sealing contact with the hole in the spacer as the screw is rotated. The collar, in another example, may have longitudinal slots in it forming arms that bow out in accordion fashion as the screw is rotated, the arms expanding behind the rim of the spacer hole. Sealant is used about and within the expandable collars and arms as needed to form a gas tight seal.

In this manner, the hole in the spacer is itself provided with a first seal, and the sealant that is provided in the bore in the frame provides a second, backup seal, all for the purpose of resisting permeation of gas out of or into the between-pane space.

In a preferred embodiment, a drill bit is used having a stop that prevents the drill bit from penetrating further than a predetermined distance into the framed window unit. The drill bit has a first length that forms a bore through the frame but not through the spacer, and a second length carried distally of the first length and having a reduced diameter for forming a hole through a wall of the spacer.

Also in a preferred embodiment, a riveting gun is employed, the gun employing "pop" rivets, that is, rivets that can be inserted into a hole, and that have a connecting stem that can be withdrawn to conform the head of the rivet to the hole, following which the stem breaks off and is removed. The rivets may be provided with a sealant such as butyl rubber, preferably in the form of an annular ring carried about the diameter of the rivet. The sealant forms a seal between the rivet itself and the walls of the hole formed in the spacer wall to form an airtight seal. Riveting guns may be provided with extra long rivet-bearing shafts to enable them to reach deeply into the bores formed in extra wide window stiles.

In another embodiment, the invention provides a kit for the repair of insulating glass units. The kit includes a drill bit for drilling through the frame and the spacer wall, and a drill guide configured to mount to the frame of an insulated glass unit and having a bore sized to closely receive the drill bit with the bore aligned with the spacer between the panes to ensure proper placement of the bore to be drilled through the frame.

The drill bit, in a preferred embodiment, includes a stop preventing it from extending within the window unit from the edge of the frame by more than a predetermined distance. The purpose of the stop is to prevent the drill bit from extending completely through the spacer into the between-pane space when a bore is drilled through the frame. The drill bit may also include a first drill bit portion having a length enabling the distal end of the first portion to extend to but not beyond the exterior surface of the spacer wall, and a second drill bit portion of smaller diameter than the first and extending distally of the first portion for drilling a hole in the spacer wall. The stop may be a drill bit-mounted block configured to engage the edge of the guide when the drill bit has advanced through the frame and spacer wall for the predetermined distance.

To seal the hole formed in the spacer, it is preferred to employ a rivet sized to be received within the hole in a spacer wall. Desirably, the rivet includes a ring of deformable sealant about its circumference that is sized to engage the wall of the spacer surrounding the hole formed in it. The sealant thus seals to the rivet and to the edges of the hole when the rivet is mounted in the spacer hole.

It may be desired to in some circumstances to re-fill the between-pane space with argon or other gas as part of the repair routine. This may be accomplished through the use of a small hollow lance connected at one end to a source of gas under pressure and placing the other end of the lance through the hole in the spacer to deliver gas to the between-pane space. As argon or other gas is delivered to the space, gas from within the space may escape outwardly from the hole. The concentration of gas within the space at any time may be measured by measuring the gas concentrations escaping from the hole. Once the between-pane space has been appropriately purged, the hole and the bore through the frame are appropriately plugged as described above.

DESCRIPTION OF THE PREFERRED EMBODIMENTS

The following detailed description should be read with reference to the drawings, in which like elements in different drawings are numbered identically. The drawings, which are not necessarily to scale, depict selected embodiments and are not intended to limit the scope of the invention. Examples of constructions, materials, dimensions, and manufacturing processes are provided for selected elements. All other elements employ that which is known to those of skill in the field of the invention. Those skilled in the art will recognize that many of the examples provided have suitable alternatives that can be utilized.

Figure 1:
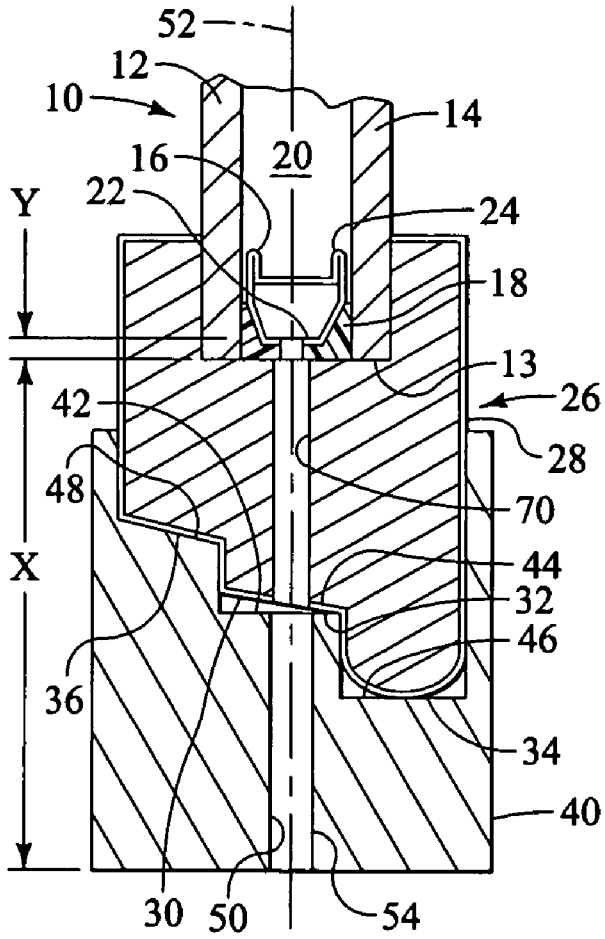
FIG. 1 is a broken-away view, in partial cross section, of an insulating glass unit with peripheral frame, together with a drill guide block, at a point in the repair procedure.

Referring first to FIG. 1, an insulating glass unit is shown generally as 10, the unit comprising a pair of spaced glass panes 12, 14, separated at their peripheries by a spacer 16. The spacer is adhered to the confronting surfaces of the glass panes by an adhesive/sealant 18, which may include a polyisobutylene ("PIB") sealant between flat sections of the spacer and confronting surfaces of the panes, together with a silicone rubber sealant further adhering the spacer to the glass panes. In this construction, the PIB sealant serves as a barrier to retard gas permeation between the atmosphere and the between-pane space 20, while the silicone rubber serves primarily as an adhesive to adhere the panes to the spacer.

The spacer 16, as shown, may be (but not necessarily is) generally tubular, having an outer wall 22 adjacent the edges of the glass panes, and an inner wall 24. The spacer may contain a particulate desiccant, such as a zeolite, and the inner wall 24 may have small holes in it to enable moisture in the between-pane space to be absorbed by the desiccant. Encasing the periphery of the insulating glass unit in a known manner is a frame 26, the frame optionally being itself encased in a protective polymer casing 28.

The frame as shown includes a generally flat-bottomed groove to receive the insulating glass unit. A variety of frame configurations are common in the field and tend to vary from manufacturer to manufacturer. FIG. 1 depicts one such frame configuration, but it will be understood that the invention is not dependent on any particular frame design or configuration. The frame 26 of FIG. 1 includes an edge 30 facing away from the insulating glass unit. The edge typified in FIG. 1 may have a configuration including a central portion 32, an upstanding side portion 34 and a recessed second side portion 36, but other configurations are also used. For example, the edge 30 may be formed as a flat wall formed at an angle to the plane of the panes. Insulating glass units and their frames as thus described are well known and need no further description.

Of importance in the practice of the present invention is the step of establishing the proper location of the bore to be drilled through the frame of an insulating glass unit. If the bore is out of alignment with the center of the spacer between the glass panes, advancement of the drill bit to form a hole in the spacer wall may result in contact of the drill bit with the glass pane edges, which can cause breakage of the glass.

As shown in FIG. 1, a drill guide 40 is employed, the drill guide having a face 42 that is configured to mate with the edge 30 of the frame. In the embodiment depicted in FIG. 1, the drill guide has surfaces 44, 46 and 48 configured to contact the frame edge surfaces 32, 34 and 36, respectively. The drill guide has a bore 50 formed in it and having an axis 52 that passes essentially through the center of the spacer wall 22; that is, midway between the panes 12, 14. In the embodiment depicted, the drill guide has a generally flat rear surface 54 that is perpendicular to the axis 52.

Various embodiments of stop 64 are possible without deviating from the spirit and scope of the present invention. For example, stop 64 may take the form of the distal end 68 of the chuck 58. By way of another example, drill bit 56 and stop 64 may be formed from a single piece of material. In this exemplary embodiment, stop 64 may take the form of a permanent shoulder.

Figure 2:
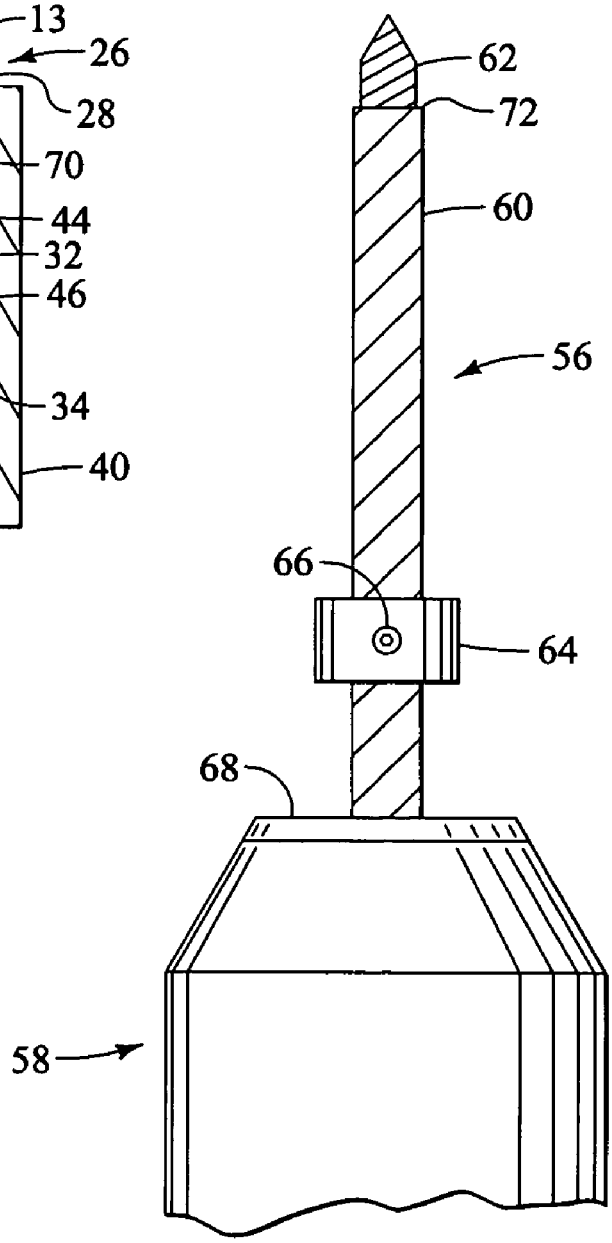
FIG. 2 is a broken-away view of a drill bit useful in practicing the method of the invention.

In the preferred embodiment, and with reference to FIG. 2, a drill bit 56 is employed, the drill bit being received in the chuck of a drill designated generally 58. The drill bit has a first drill portion 60, and, in the preferred embodiment, a short second drill section 62 protruding from the end of the section 60 and of lesser diameter than the section 60. The drill bit portion 60, as will now be understood, provides the bore through the frame of an insulating glass unit, while moveable stop can also be permanent the second drill portion 62 is employed for drilling through the wall of the spacer. Along its length, the drill bit 56 includes a stop 64, which, as shown, may simply be a cylindrical bushing that is snuggly received over the diameter of the drill bit portion 60 and held in place with a set screw 66.

Referring again to FIGS. 1 and 2, it will be understood that the drill bit 56 is passed inwardly through the bore 50 formed in the drill guide and is advanced into the frame itself, forming a bore 70. The drill bit is advanced until the stop 64 comes into contact with the outer edge 54 of the drill guide, and it will be understood that the stop has been so adjusted along the length of the drill bit so that at this point, the forward end 72 of the first drill bit section passes completely through the frame but does not come into contact with the spacer wall. The second drill portion 62 of lesser diameter which extends distally from the end of the drill bit cuts a hole through the outer wall 22 of the spacer.

As mentioned above, different window frame designs employ different sized and configured frames. Casement windows for a residence, for example, employ frames that do not extend for more than a few inches beyond the peripheral edges of the glass panes. On the other hand, sliding glass doors or French doors may have wide frames or stiles, with varying edge configurations. To accommodate frames of varying dimensions and configurations, one may employ a variety of drill bit guides 40 having the desired configurations. To control how deeply the drill bit penetrates, the stop may be adjusted along the length of the drill bit. Preferably, however, the length of the first portion 60 of the drill bit that extends from the stop 64 will be permitted to remain constant, permitting the stop 64 to be permanently mounted to the drill bit. This distance, then, corresponds to the distance "X" in FIG. 1, and as one moves from one size of frame to another, one may simply use a drill guide that is dimensioned so that its outer edge 54 always is spaced from the edges 13 of the glass panes by distance X.

The second drill bit portion 62 of smaller diameter protrudes from the end 72 of the first drill bit portion by a distance Y (FIG. 1) sufficient to enable the drill bit tip to drill through the outer spacer wall but not through the inner spacer wall as the stop 64 comes to rest against the drill guide surface 54.

Figure 3:
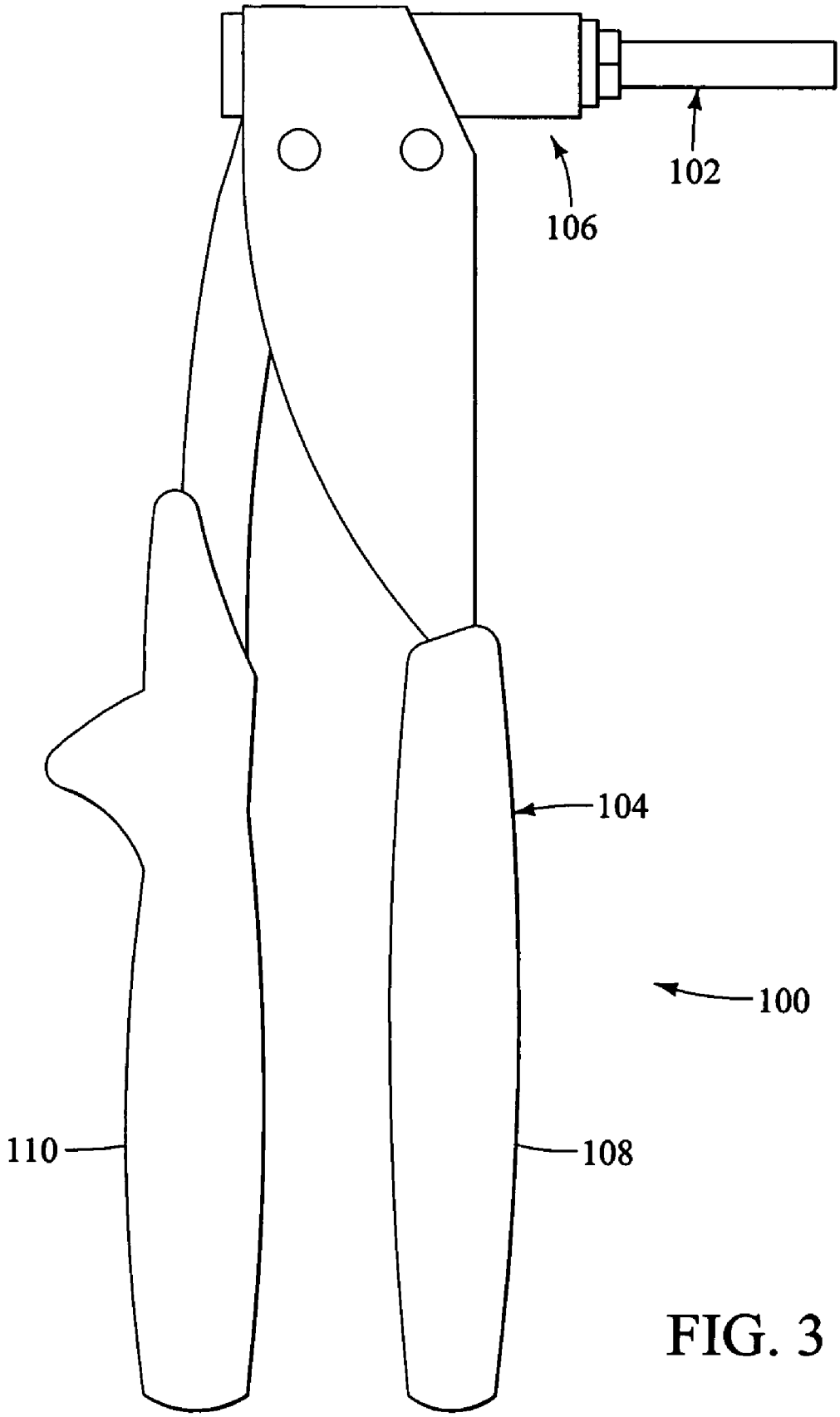
FIG. 3 is a plan view of a rivet gun assembly including a riveting fixture for use in accordance with an exemplary method of the present invention.

FIG. 3 is a plan view of a rivet gun assembly 100 including a riveting fixture 102 for use in accordance with an exemplary method of the present invention. Rivet gun assembly 100 includes a rivet gun 104 having a nose portion 106, a first handle 108 and a second handle 110. In the embodiment of FIG. 3, riveting fixture 102 is threadingly received by nose portion 106 of rivet gun 104.

Figure 4:
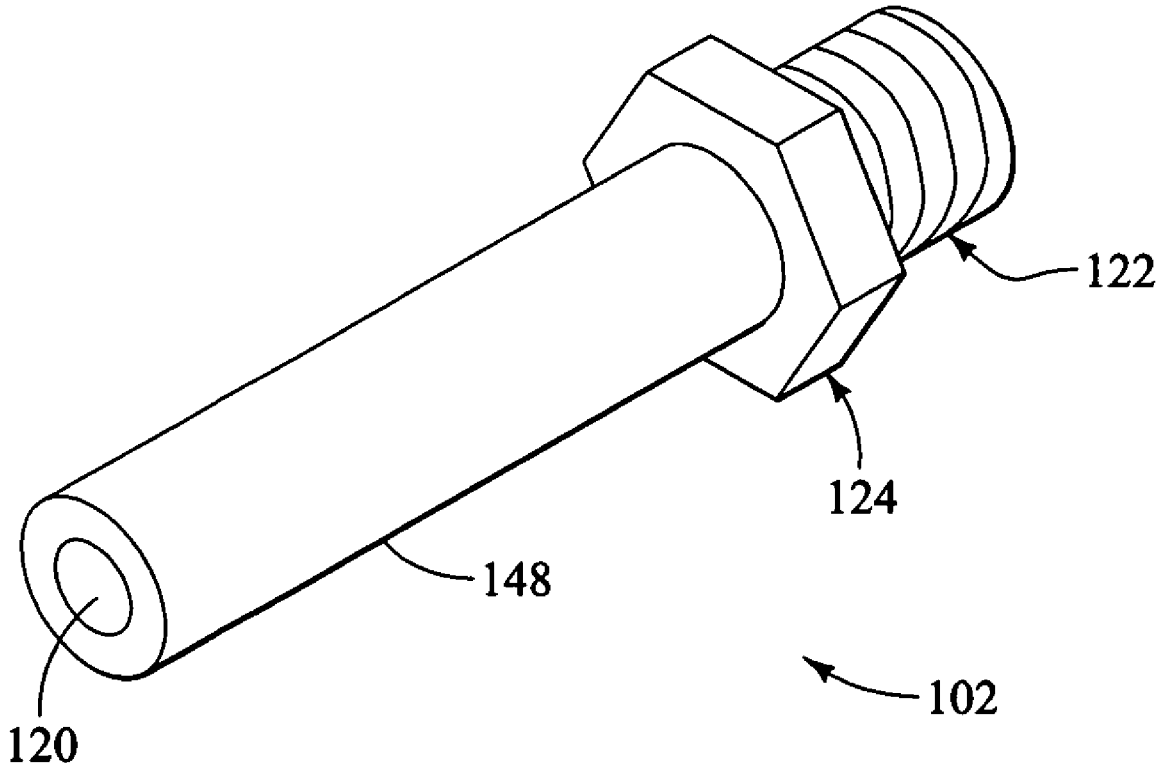
FIG. 4 is a perspective view of the riveting fixture of FIG. 3.

FIG. 4 is a perspective view of riveting fixture 102 of FIG. 3. In FIG. 4, it may be appreciated that riveting fixture 102 includes a tubular body 148 defining a lumen 120. Riveting fixture 102 also includes a threaded portion 122 which may be received by the nose portion 106 of rivet gun 104 of FIG. 3. Additionally, riveting fixture 102 includes a hexagonal portion 124. Hexagonal portion 124 is preferably adapted to mate with a wrench for installing riveting fixture 102 into nose portion 106 of rivet gun 104.

Figure 5:
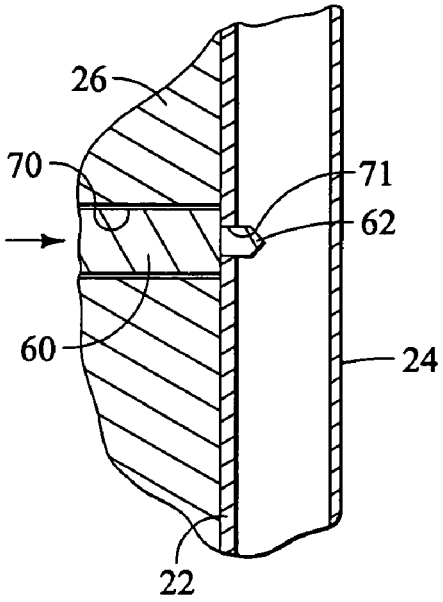
FIG. 5 is a broken-away view, in partial cross section, illustrating a step in practicing an exemplary method in accordance with the present invention.

FIGS. 5 through 9 illustrate steps in a preferred method of the invention. In FIG. 5, the first portion 60 of the drill bit has passed completely through the frame 26 to form a bore 70, and the second drill bit portion 62 is passed through the outer wall 22 of the spacer to form a bore 71. The drill bit is then withdrawn, permitting the insulating glass unit to "breathe" as gas either rushes in or rushes out of the between-pane space.

Once pressure across the panes has been equalized so that the panes have regained substantially parallelism, the rivet shown generally as 74 is advanced through the bore 70 so that the head 76 of the rivet is received in the hole 71 formed in the outer spacer wall. The rivet 74, as thus depicted, includes a metal stem 78 that extends rearwardly and that is gripped in the jaws of rivet gun 104. In a preferred embodiment, metal stem 78 of rivet 74 is dimensioned so that the metal stem 74 extends beyond frame 26 when head 76 is received in hole 71. In this preferred embodiment, metal stem 78 may be gripped by the jaws of a rivet gun which are disposed adjacent to frame 26.

Figure 6:
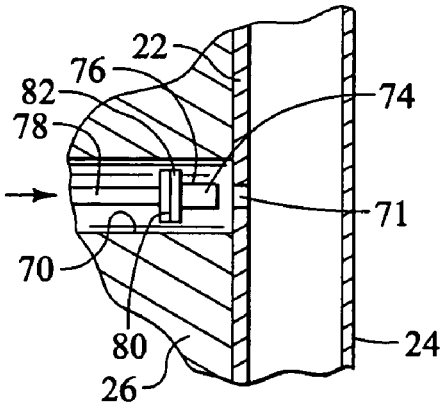
FIG. 6 is a broken-away view, in partial cross section, illustrating a step in practicing an exemplary method in accordance with the present invention.

FIG. 6 depicts the rivet 74 just before the rivet head 76 enters the hole 71 formed in the outer wall of the spacer. The head 76 of the rivet is generally cylindrical, and terminates rearwardly (that is, to the left in FIG. 6) in a flange 80. Disposed about the head 76 of the rivet, and against the forward shoulder of the flange 80, is an annular ring 82 of a deformable sealant such as PIB, and it will be noted that the diameter of the sealant ring 82 and the diameter of the flange 80 are larger than the diameter of the hole 71 formed in the spacer wall, whereas the head 76 of the rivet is slightly smaller in diameter than the hole 71. It should be noted that methods in accordance with the present invention are possible in which the rivet 74 is used without annular ring 82.

The rivet is pushed forwardly into the hole 71, and, by the usual action of the riveting gun, the stem 78 is pulled rearwardly with substantial force. The forward end of the rivet stem (not shown) may be enlarged and is so formed that as the stem is pulled rearwardly, it deforms the head 76 of the rivet in the manner shown in FIG. 7 so that the head of the rivet conforms to the inner surface of the spacer wall 22. Simultaneously, the sealant ring 82 deforms into contact with the outer surface of the spacer wall 22, and may in fact squeeze slightly into the annular space between the rivet head and the surrounding walls of the hole formed in the spacer wall. As further rearward force is exerted on the rivet stem 78, the stem breaks off and is removed.

Figure 8:
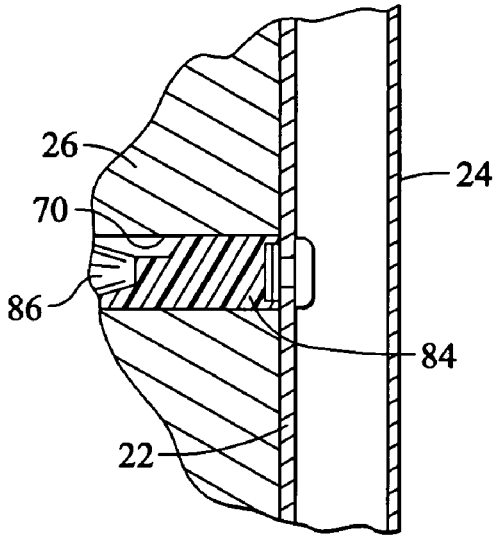
FIG. 8 is a broken-away view, in partial cross section, illustrating a step in practicing an exemplary method in accordance with the present invention.

Thereafter, the hole 70 is filled with a sealant 84, which desirably is a self-curing silicone rubber applied from a pressure gun nozzle 86 (FIG. 8). The silicone sealant 84 completely fills the bore 70, providing, due to its length, a significant barrier to gas infiltration.

Figure 9:
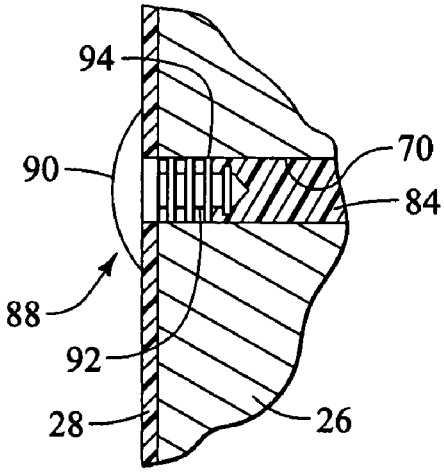
FIG. 9 is a broken-away view, in partial cross section, illustrating a step in practicing an exemplary method in accordance with the present invention.
Figure 7:
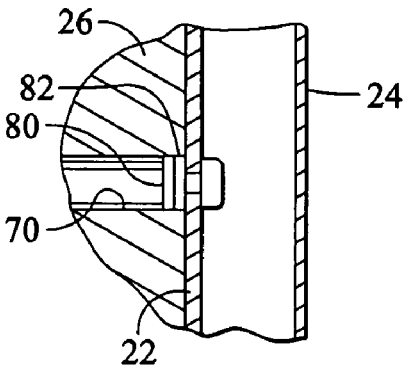
FIG. 7 is a broken-away view, in partial cross section, illustrating a step in practicing an exemplary method in accordance with the present invention.

Referring now to FIG. 9, once the bore 70 has been filled with the sealant 84, but before the sealant has set, we prefer to apply a small, largely decorative cap 88 to the bore 70, the cap having an enlarged, circular head 90 which rests upon the outer surface of the protective polymer casing 28, the cap having an elongated portion 92 extending inwardly slightly of the bore 70. Further, the latter portion may be provided with ribs 94 or the like to securely hold it to the silicone sealant 84.

To the extent that any disassembly of the frame elements were required in order to facilitate the repair thus described, these elements are now reinstalled, and the insulating glass window, having a between-pane space that is in equilibrium with atmospheric pressure, is ready for use.

Methods in accordance with the present invention are possible in which an element other than a rivet is inserted into hole 71 in outer wall 22. For example, methods are possible in which a screw is inserted into hole 71. For example, a self-threading screw may be threaded into hole 71.

Figure 10:
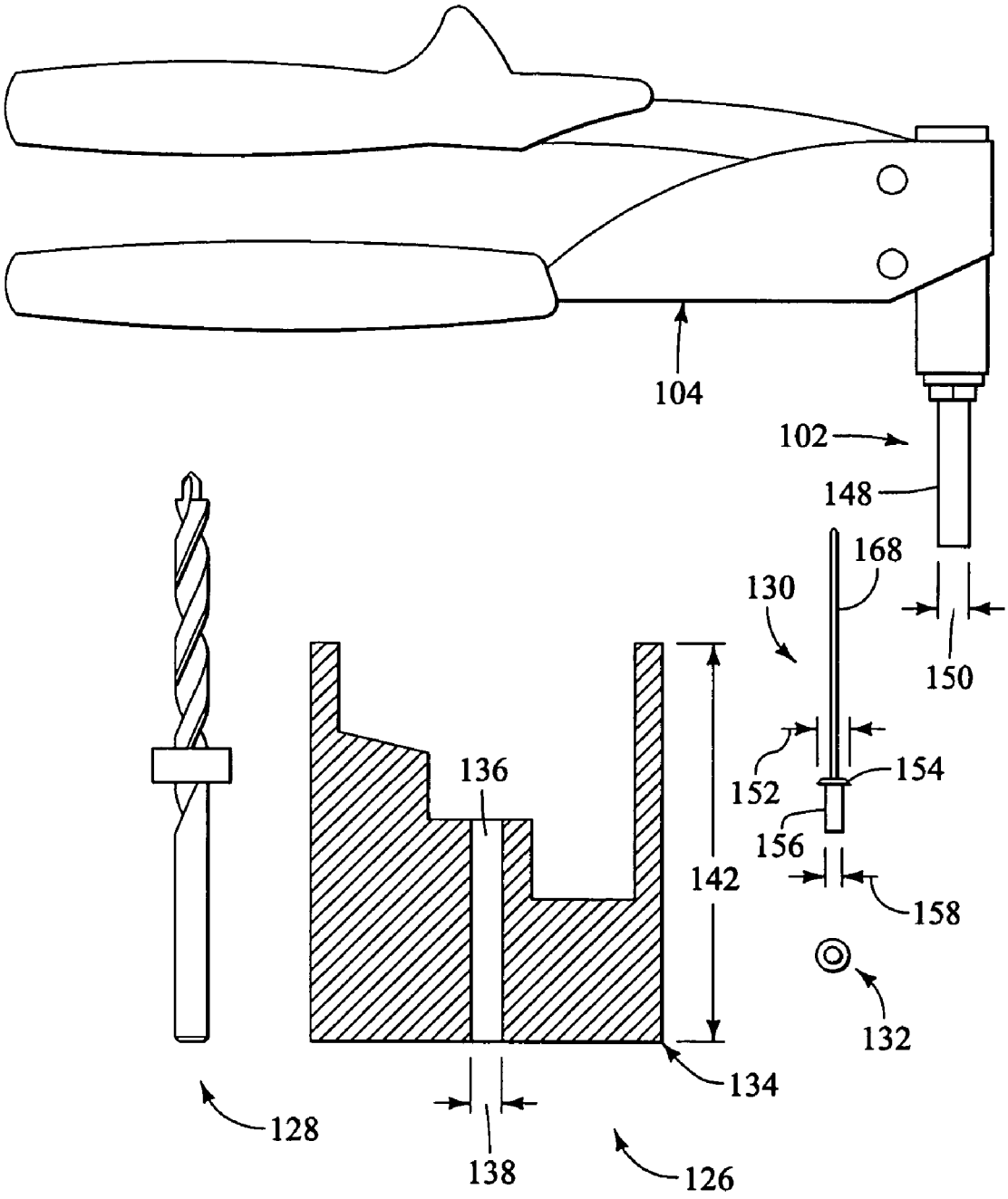
FIG. 10 is a plan view of a kit in accordance with an exemplary embodiment of the present invention.

FIG. 10 is a plan view of a kit 126 in accordance with an exemplary embodiment of the present invention. Kit 126 may be used to repair an insulating glass unit. In the embodiment of FIG. 10, kit 126 includes a drill bit assembly 128, a rivet 130, a gasket 132, a drilling fixture 134, a rivet gun 104 and a riveting fixture 102. Rivet 130 includes a stem 168, a flange 154 and a body portion 156. Flange 154 of rivet 130 has a flange diameter 152. Body portion 156 of rivet 130 has a body diameter 158.

Figure 11:
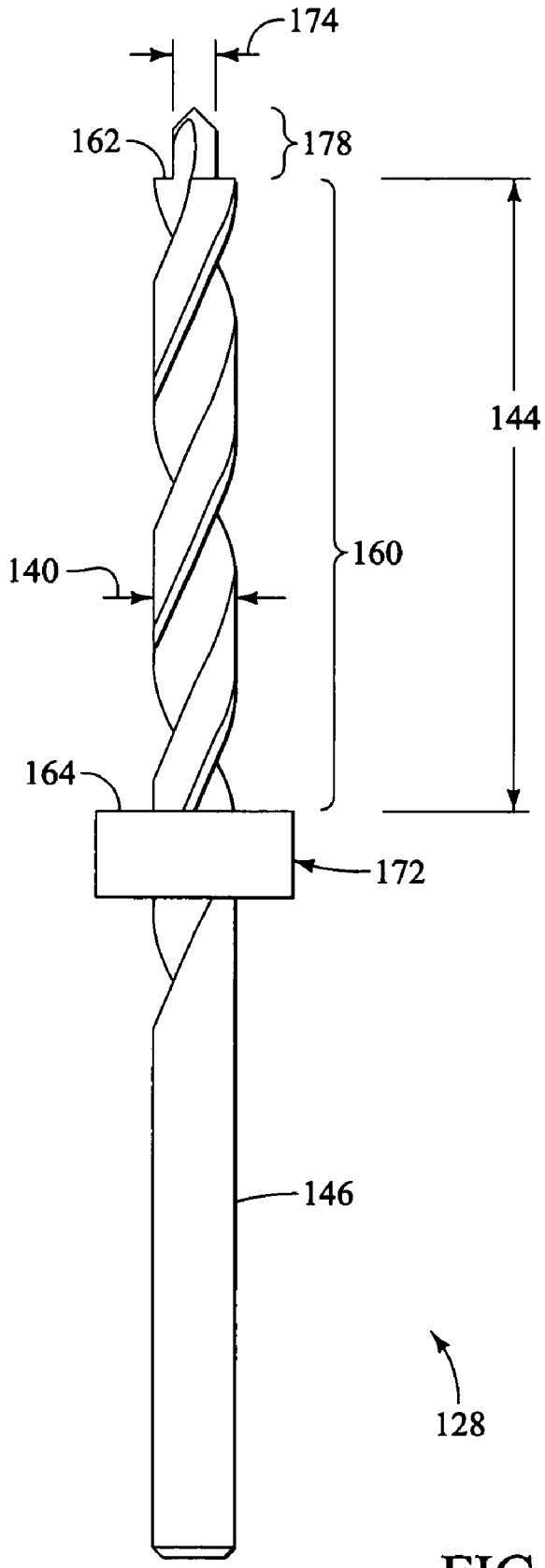
FIG. 11 is an enlarged plan view of a drill assembly in accordance with an exemplary embodiment of the present invention.

FIG. 11 is an enlarged plan view of drill bit assembly 128. As shown in FIG. 11, drill bit assembly 128 includes a drill bit 146 and a collar 172. Drill bit 146 includes a second portion 178 terminating at a first shoulder 162. Drill bit 146 also has a first portion 160 extending between first shoulder 162 and a stopping surface 164 of collar 172. First portion 160 of drill bit 146 has a first portion diameter 140. In a preferred embodiment, first portion diameter 140 is similar to flange diameter 152 of rivet 130. For example, in one embodiment, first portion diameter 140 of drill bit 146 is slightly larger than flange diameter 152 of rivet 130. In FIG. 11 it may also be appreciated that first portion 160 of a drill bit 146 has a first portion length 144.

In a preferred embodiment, second portion 178 of drill bit 146 has a second portion diameter 174 which is similar to a body diameter 158 of rivet 130. For example, in one embodiment, second portion diameter 174 of second portion 178 is substantially equal to body diameter 158 of rivet 130. Since drill bits may sometimes drill slightly oversized, a second portion 178 having a second portion diameter 174 substantially equal to body diameter 158 of rivet 130 is likely to create a hole which will readily accept body portion 156 of rivet 130.

Referring again to FIG. 10, it may be appreciated that kit 126 includes a drilling fixture 134. In the embodiment of FIG. 10, drilling fixture 134 defines a guide hole 136. Guide hole 136 has a guide hole diameter 138. In a preferred embodiment, guide hole diameter 138 of guide hole 136 is similar to first portion diameter 140 of first portion 160 of drill bit 146. For example, in one embodiment, guide hole diameter 138 of guide hole 136 is slightly larger than first portion diameter 140. Drilling fixture 134 also has a fixture thickness 142. In a preferred embodiment, fixture thickness 142 and first portion length 144 of drill bit 146 are configured such that first portion 160 of drill bit 146 will drill through the sash portion of the window, but will not drill through the wall of a spacer of the window assembly.

Also in FIG. 10, it may be appreciated that riveting fixture 102 includes a tubular body 148 having a riveting fixture diameter 150. In a preferred embodiment, riveting fixture diameter 150 is similar to flange diameter 152 of rivet 130. In the exemplary embodiment of FIG. 10, riveting fixture diameter 150 is slightly smaller than flange diameter 152 of rivet 130. In this exemplary embodiment, riveting fixture 102 is configured such that it will pass easily through any hole that flange 154 of rivet 130 passes through.

Figure 12:
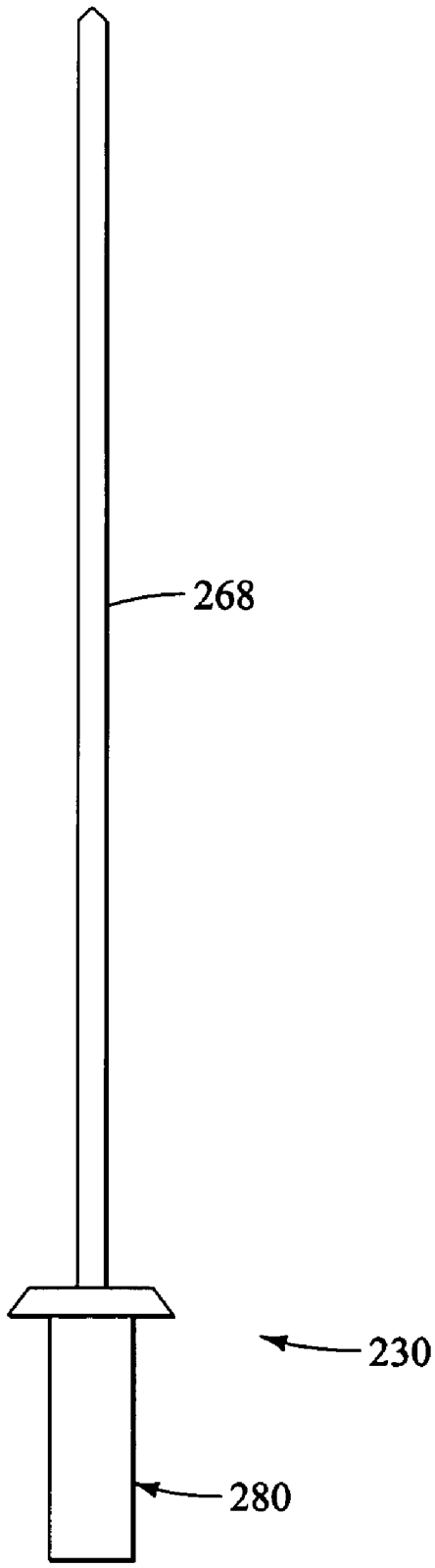
FIG. 12 is a plan view of a rivet in accordance with an exemplary embodiment of the present invention.

FIG. 12 is a plan view of a rivet 230 in accordance with an exemplary embodiment of the present invention. Rivet 230 includes a stem 268 and a body 280. In a preferred embodiment, the length of stem 268 is selected so that stem 268 will extend beyond the frame of a window when the body 280 of rivet 230 is inserted into a hole in a spacer wall of the window. In this preferred embodiment, stem 268 may be gripped by the jaws of a rivet gun which are disposed adjacent to the frame of the window.

Figure 13:
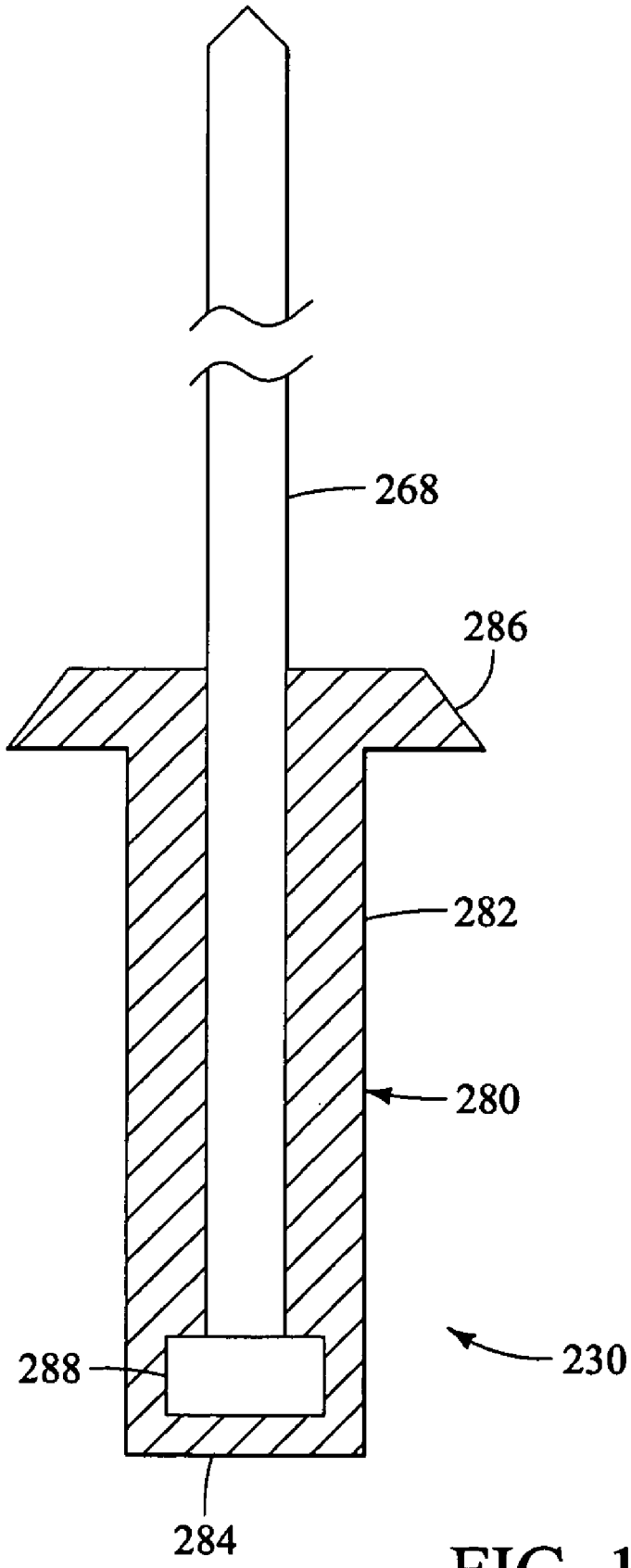
FIG. 13 is an enlarged partial cross sectional view of the rivet of FIG. 12.

FIG. 13 is an enlarged partial cross sectional view of rivet 230 of FIG. 12. In FIG. 13 it may be appreciated that body 280 of rivet 230 comprises an end wall 284 fixed to a generally cylindrical side wall 282. Body 280 of rivet 230 also includes a flange 286. In one exemplary embodiment of the present invention, stem 268 is comprised of steel and body 280 is comprised of aluminum. In this exemplary embodiment, body 280 may be formed about stem 268 for example by die casting. In the embodiment of FIG. 13, stem 268 includes a head 288.

Figure 14:
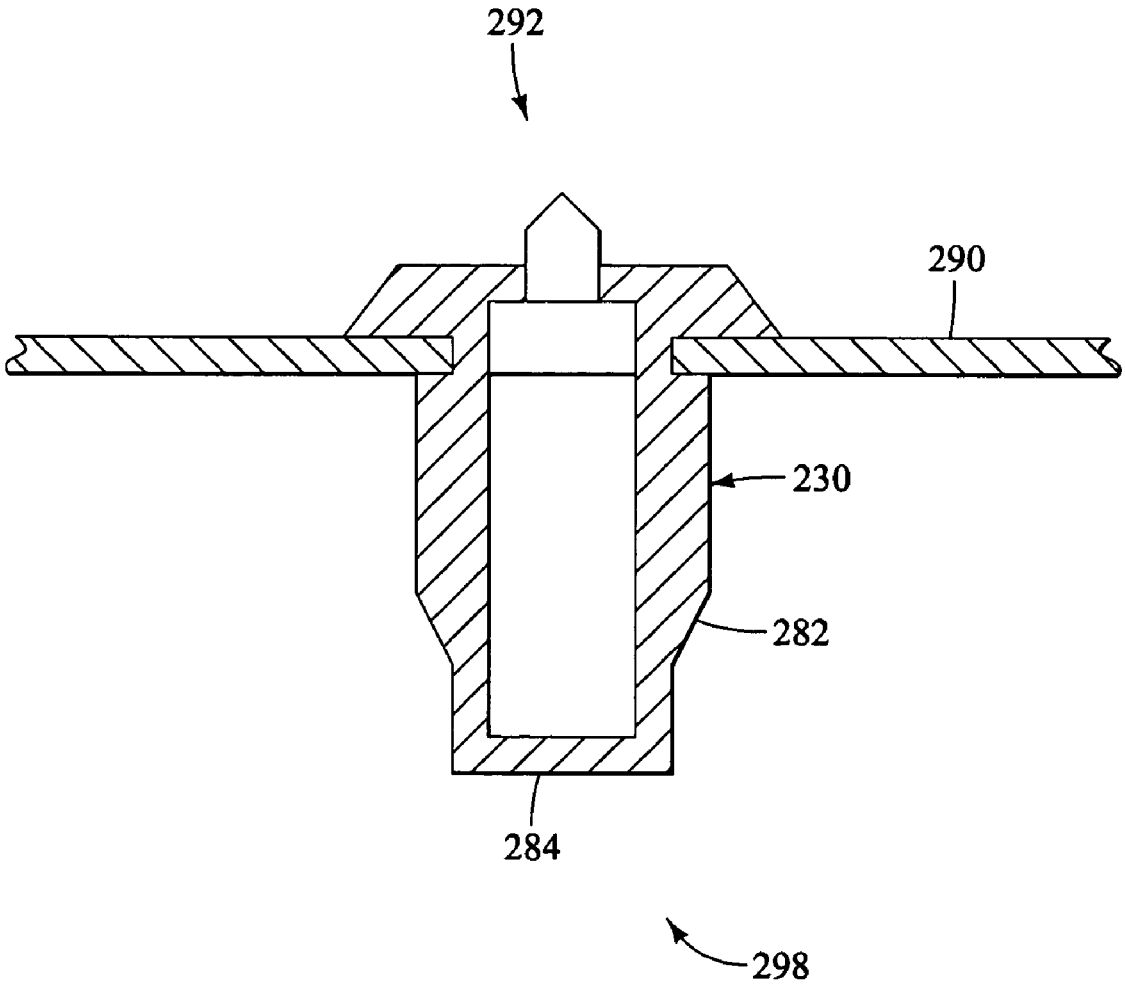
FIG. 14 is a partial cross sectional view of an assembly in accordance with the present invention.

FIG. 14 is a partial cross sectional view of an assembly 298 in accordance with the present invention. Assembly 298 includes a wall 290 and a rivet 230. Wall 290 may be, for example, the outer spacer wall of a spacer of a window. In FIG. 14 it may be appreciated that rivet 230 has been deformed so as to seal a hole 292 in wall 290. Rivet 230 may be deformed, for example, using a rivet gun. In FIG. 14 it may be appreciated that side wall 282 and end wall 284 of rivet 230 extend completely across hole 292 in wall 290.

A method in accordance with the present invention may include the step of inspecting an insulating glass unit and determining if the insulating glass unit has developed a pressured differential relative to atmosphere. In some cases, a visual inspection will reveal that an insulating glass unit has developed a pressure differential. For example, the panes of an insulating glass unit may be visibly bowed or cupped. In fact, when an insulating glass unit becomes severely under-pressured, the panes of the unit may actually touch near the center of the unit, sometimes causing a visible halo to be seen.

In some applications, the step of inspecting the insulating glass unit may include the step of measuring the over all width of the insulating glass unit and/or measuring the width of the between-pane space. Various measuring methods can be used without deviating from the spirit and scope of the present invention. For example, a laser thickness gage can be used to measure the width of the between-pane space. A laser thickness gage, for example, makes laser reflections off the surfaces of the panes, with the reflections appearing on a graduated scale of the gage. These reflections indicate the thickness of the panes, as well as the thickness of the air space separating the panes. A laser thickness gage which may be suitable in some applications is commercially available from EDTM Incorporated of Toledo, Ohio, U.S.A. which identifies it by the trade name MIG-MG 1500.

The step of determining whether an insulating glass unit should be repaired may include the steps of measuring the between-panes space, and comparing the measured width to a preselected repair with value. For example, it may be desirable to repair an insulating glass unit when the pressure differential on the unit causes the panes to deflect outwardly by five millimeters. By way of second example, when the pressure in the between-panes space is less than atmospheric pressure, it may be desirable to repair an insulating glass unit when the panes of the unit are separated by less than about one millimeter. Of course, repair criteria may vary for different applications. Once it is determined that the panes of an insulating glass unit have a deflection that exceeds a certain magnitude, a repair method in accordance with the present invention may be used to correct the deflection of the panes.

While a preferred embodiment of the present invention has been described, it should be understood that various changes, adaptations and modifications may be made therein without departing from the spirit of the invention and the scope of the appended claims.

What is claimed is:

1. A kit for repair of an insulating glass unit having a pair of glass panes and a peripheral spacer having a wall extending between the panes, the panes and spacer defining a between pane space and the glass unit being encased in a peripheral frame having a plurality of non-coplanar frame edge surfaces, the kit comprising:

a. a drill bit assembly for drilling a hole through the frame and spacer wall, the drill bit assembly including a drill bit;

b. a drill guide having a plurality of non-coplanar contact surfaces configured to mate with the frame edge surfaces and having a bore positioned to guide the drill bit through the spacer wall midway between the panes into the between pane space; and c. a rivet receivable within the hole drilled in the spacer wall.

2. The kit of claim 1, wherein the rivet includes a deformable sealant coating capable of sealing the rivet to the spacer wall.

3. The kit of claim 1, further including a gasket.

4. The kit of claim 3, wherein the gasket comprises an elastomeric material.

5. The kit of claim 1, wherein the drill bit has a first drill bit portion having a second diameter that is similar to a body diameter of a body portion of the rivet, and a second drill bit portion having a first diameter that is similar to a flange diameter of a flange of the rivet, and wherein the length of the first drill bit portion is greater than the thickness of the spacer wall.

6. The kit of claim 1, further including a riveting fixture.

7. The kit of claim 6, wherein the riveting fixture has a diameter that is similar to a flange diameter of a flange of the rivet.

8. The kit of claim 1 wherein the drill bit assembly further includes a stop preventing it from extending within the window unit from the edge of the frame by more than a predetermined distance, a first drill bit portion having a length such that the distal end of the first portion extends to but not beyond the exterior surface of the spacer wall, and a second drill bit portion of smaller diameter than the first drill bit portion and extending distally of the first portion for drilling a hole in the spacer.

9. The kit of claim 1, wherein the rivet includes a stem that is dimensioned so that the stem extends beyond the peripheral frame when the rivet is received in the hole drilled in the spacer wall.

10. The kit of claim 1, wherein the rivet includes a body having an end wall fixed to a generally cylindrical side wall.

11. A kit for repair of an insulating glass unit having a pair of glass panes and a peripheral spacer having a wall extending between the panes, the panes and spacer defining a between pane space and the glass unit being encased in a peripheral frame, the kit comprising:

a. a drill bit assembly for drilling a hole through the frame and spacer wall, the drill bit assembly including a drill bit; and b. a rivet receivable within the hole drilled in the spacer wall, wherein the drill bit has a first drill bit portion having a second diameter that is similar to a body diameter of a body portion of the rivet, and a second drill bit portion having a first diameter that is similar to a flange diameter of a flange of the rivet, and wherein the length of the first drill bit portion is greater than the thickness of the spacer wall, and wherein the frame includes a plurality of non-coplanar frame edge surfaces and the kit further comprises a drill guide configured to mate with the frame edge surfaces and having a bore positioned to guide the drill bit through the spacer wall midway between the panes into the between pane space.

12. The kit of claim 11, wherein the rivet includes a deformable sealant coating capable of sealing the rivet to the spacer wall.

13. The kit of claim 11, further including an elastomeric gasket.

14. The kit of claim 11, further including a riveting fixture having a diameter that is similar to a flange diameter of a flange of the rivet.

15. The kit of claim 11, wherein the drill bit assembly further includes a stop preventing it from extending within the window unit from the edge of the frame by more than a predetermined distance, a first drill bit portion having a length such that the distal end of the first portion extends to but not beyond the exterior surface of the spacer wall, and a second drill bit portion of smaller diameter than the first drill bit portion and extending distally of the first portion for drilling a hole in the spacer.

16. The kit of claim 11, wherein the rivet includes a stem that is dimensioned so that the stem extends beyond the peripheral frame when the rivet is received in the hole drilled in the spacer wall.

17. The kit of claim 11, wherein the rivet includes a body having an end wall fixed to a generally cylindrical side wall.

18. A kit for repair of an insulating glass unit having a pair of glass panes and a peripheral spacer having a wall extending between the panes, the panes and spacer defining a between pane space and the glass unit being encased in a peripheral frame having a plurality of non-coplanar frame edge surfaces, the kit comprising:

a. a drill bit assembly for drilling a hole through the frame and spacer wall, the drill bit assembly comprising a drill bit and a stop;

b. a drill guide configured to mate with the frame edge surfaces and having a bore positioned to guide the drill bit through the spacer wall midway between the panes into the between pane space; and c. a rivet receivable within the hole drilled in the spacer wall, wherein the drill bit includes a first drill bit portion having a second diameter that is similar to a body diameter of a body portion of the rivet, and a second drill bit portion having a first diameter that is similar to a flange diameter of a flange of the rivet, and wherein the length of the first drill bit portion is greater than the thickness of the spacer wall, and wherein the stop is configured to prevent the second drill bit portion from contacting the spacer wall.

* * * * *